US009923307B2

(12) United States Patent
Beischer et al.

(10) Patent No.: US 9,923,307 B2
(45) Date of Patent: Mar. 20, 2018

(54) RETAINING FRAME FOR RETAINING PLUG-IN CONNECTOR MODULES

(71) Applicant: Harting Electric GmbH & Co. KG, Espelkamp (DE)

(72) Inventors: Thomas Beischer, Espelkamp (DE); Heiko Meier, Minden (DE); Ingo Siebering, Kirchlengern (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 165 days.

(21) Appl. No.: 14/442,204

(22) PCT Filed: Nov. 13, 2013

(86) PCT No.: PCT/DE2013/100382
§ 371 (c)(1),
(2) Date: May 12, 2015

(87) PCT Pub. No.: WO2014/075662
PCT Pub. Date: May 22, 2014

(65) Prior Publication Data

US 2016/0276778 A1 Sep. 22, 2016

(30) Foreign Application Priority Data

Nov. 13, 2012 (DE) ..... 10 2012 110 907

(51) Int. Cl.
*H01R 13/639* (2006.01)
*H01R 13/514* (2006.01)
*H01R 13/518* (2006.01)

(52) U.S. Cl.
CPC ..... *H01R 13/639* (2013.01); *H01R 13/514* (2013.01); *H01R 13/518* (2013.01)

(58) Field of Classification Search
CPC ..... H01R 24/64; H01R 2107/00; H01R 13/6658; H01R 13/506; H01R 13/518;
(Continued)

(56) References Cited

U.S. PATENT DOCUMENTS 3,858,960 A * 1/1975 Kunkle ..... H01R 13/595 439/472
4,640,107 A * 2/1987 Slade ..... E05B 73/00 439/133
(Continued)

FOREIGN PATENT DOCUMENTS

DE 19707120 6/1998
EP 2312700 4/2011
(Continued)

*Primary Examiner* — Truc Nguyen
(74) *Attorney, Agent, or Firm* — Jacobson Holman, PLLC.

(57) ABSTRACT

It is proposed to design a retaining frame (1) for retaining plug-in connector modules (40) in such a way that retaining means (41) of the plug-in connector modules (40) can be retained in recesses (11) of the retaining frame (1) in a play-free manner. To this end, the retaining frame (1) is designed in two pieces, wherein a slot (2/3) between the two retaining frame pieces (2/3) extends through the recesses (11). By under-sizing the recesses (11) in relation to the dimension of the retaining means (41) of plug-in connector modules (40), a press-fit of the retaining means (41) in the recesses (11) is effected by the assembly of the retaining frame parts (2, 3).

7 Claims, 5 Drawing Sheets

(58) Field of Classification Search
CPC .. H01R 13/6275; H01R 13/639; H01R 24/60; H01R 13/193; H01R 13/65802; H01R 13/502; H01R 13/6581; H01R 13/659; H01R 13/6594
See application file for complete search history.

(56) References Cited

U.S. PATENT DOCUMENTS 5,091,991 A * 2/1992 Briggs ..... G02B 6/3825 385/52
5,098,315 A * 3/1992 Scowen ..... H01R 13/5221 439/587
5,190,465 A * 3/1993 Davidge ..... H01R 13/60 439/133
5,376,018 A * 12/1994 Davis ..... H01R 13/65802 439/395
5,516,984 A * 5/1996 Soes ..... H01R 13/5829 439/467
5,908,180 A * 6/1999 Daoud ..... F16L 5/04 248/56
6,004,163 A * 12/1999 Behling ..... H01R 13/514 439/362
6,059,300 A * 5/2000 Wu ..... B62B 1/08 248/229.11
6,338,651 B1 * 1/2002 Svette, Jr. ..... H01R 13/5202 439/559
6,354,164 B1 * 3/2002 Megason ..... F16H 51/00 439/157
6,699,060 B1 * 3/2004 Scott ..... H01R 13/6395 439/373
6,786,770 B1 * 9/2004 Huang ..... H01R 13/6595 439/607.55
7,283,369 B2 * 10/2007 Chang ..... H05K 5/0208 200/330
7,384,304 B1 * 6/2008 Fawcett ..... H01R 13/6395 439/567
8,146,879 B2 * 4/2012 Liao ..... A45B 11/00 135/135
8,491,335 B2 * 7/2013 Matsumoto ..... H01R 13/506 439/587
9,166,337 B2 * 10/2015 Boswell ..... H01R 13/6395
9,419,381 B2 * 8/2016 Shimizu ..... H01R 13/6581
2004/0242059 A1 12/2004 Aoyama et al.
2006/0223359 A1 * 10/2006 O'Connell ..... H01R 13/447 439/373
2009/0269977 A1 10/2009 Chen et al.
2010/0285681 A1 * 11/2010 Saruwatari ..... H01R 13/6395 439/345
2012/0244730 A1 * 9/2012 Grimm ..... H01R 13/447 439/142

FOREIGN PATENT DOCUMENTS

JP 62-171170 10/1987
JP 2004362779 12/2004
WO WO 2009/124797 10/2009

* cited by examiner

RETAINING FRAME FOR RETAINING PLUG-IN CONNECTOR MODULES

DESCRIPTION

The invention relates to a retaining frame for plug-in connector modules formed from a frame base and a securing frame.

Such retaining frames are used for retaining plug-in connector modules; the retaining frame is equipped with various plug-in connector modules and is subsequently inserted into a plug-in connector housing and fastened therein. In this connection, the retaining frame must be mechanically stable so as to be able to withstand the insertion and extraction forces occurring during the joining and separating of the plug-in connector.

Retaining frames of this type may also be screwed onto a housing or device wall instead of being inserted into a plug-in connector housing. In this way, contacting and/or connecting of conductors can be realised through the housing or device wall.

PRIOR ART

DE19707120C1 shows a retaining frame for retaining plug-in connector modules. The plug-in connector modules are inserted into the retaining frame and retaining means on the plug-in connector modules cooperate with recesses provided on opposite wall portions of the retaining frame and retain the plug-in connector module in the retaining frame in an interlocking manner.

What has an adverse effect in the case of the retaining frame known from the prior art is that if a retaining frame is not completely equipped, the plug-in connector modules accommodated by the retaining frame have a certain amount of play.

This play is due to the tolerance of retaining means of the plug-in connector modules relative to the recesses on the retaining frame into which they are inserted. Since these retaining means are relatively small compared to the overall size of the plug-in connector modules, the retaining means are subject to a great lever force.

As a result of this great lever force, plug-in connector modules individually inserted into a retaining frame tend to wobble. Only if the retaining frame case is completely equipped, the plug-in connector modules mutually support each other and ensure a relatively play-free seating.

A certain amount of play may also develop in the course of time. If the plug-in connector is frequently plugged in and unplugged, the retaining means, which are mostly produced from plastic, may show signs of wear and tear, which in turn causes play of the modules in the retaining frame.

This occurring play of the plug-in connector modules may have a negative effect during contacting with a second retaining frame with complementary plug-in connector modules. Contacting and plugging is possible only under a high amount of force and under high friction of the plug-in connector modules.

This increased friction force leads to more rapid wear and tear of the plug-in connector modules and the contacts retained therein. In the worst case, contacting and plugging are no longer possible at all. The consequence is a tearing of the plug-in connector modules out of the retaining frame as a result of destructions on the retaining frame and/or on the plug-in connector modules.

OBJECT

The object of the invention is to form a retaining frame in such a way that a play-free seating of plug-in connector modules becomes possible. In this context, plug-in connector modules of the known type should be used without having to modify them.

This object is achieved through the features recited in the claims set forth herein.

The invention is directed to a retaining frame that is designed substantially at right angles. The retaining frame has recesses on opposite wall portions. These recesses are provided for accommodating retaining means that are located on plug-in connector modules. As a result of the reception of a plurality of plug-in connector modules in the retaining frame, a so-called modular plug-in connector is formed.

According to the invention, the retaining frame is made up of two individual parts that can be assembled together: a frame base and a securing frame that can be placed on top of the frame base.

In a special embodiment, the securing frame is made up of two individual parts which together form the securing frame. In a particular embodiment, the parts are in particular implemented to be of the same type. They may be hermaphroditically assembled and form the securing frame.

In an advantageous embodiment of this design, latching means are provided on the parts that form the securing frame. These latching means are used to hold the parts together. In this way, disassembly of the securing frame into its two parts is possible only by using a high amount of force. This is useful above all during assembly and disassembly.

According to the invention, the recesses provided in the wall portions of the retaining frame are at least partially located in a separation plane that is defined by the frame base and the securing frame.

In this connection, the recesses may be completely located in one of the retaining frame parts and may be closed by the second retaining frame part. However, it is also conceivable to provide a first part of the recesses in the frame base and a second part of the recesses in the securing frame. A mixed form of the two embodiments in a retaining frame is also conceivable.

As a result of this design of the recesses, which is open on one side, they may be sized to be smaller than the retaining means of plug-in connector modules. When assembling the frame base and the securing frame, a slot is formed in this way between the retaining frame parts.

The recesses do not necessarily have to penetrate through the whole material strength of the retaining frame. It is also conceivable to form the recesses only partially from the inside of the retaining frame into the material without in doing so completely penetrating the wall portions of the retaining frame.

According to the invention, reception means may be used to assemble a frame basis and a securing frame. As a result of the slot as described above, the retaining means of plug-in connector modules may be clamped between the frame basis and the securing frame.

In this way, the invention ensures a secure, play-free seating of plug-in connector modules in the retaining frame.

In an advantageous embodiment, the recesses are designed to be trapezoidal in the retaining frame. In this connection, the recesses are wider in the area of the securing frame than in the area of the frame base. As a result, the retaining means of plug-in connector modules are additionally stabilised and retained in the retaining frame.

Further embodiments of the invention are indicated in the dependent claims.

EMBODIMENT EXAMPLE

An embodiment example of the invention is shown in the figures and will be explained in more detail below, wherein.

Figure 5A:
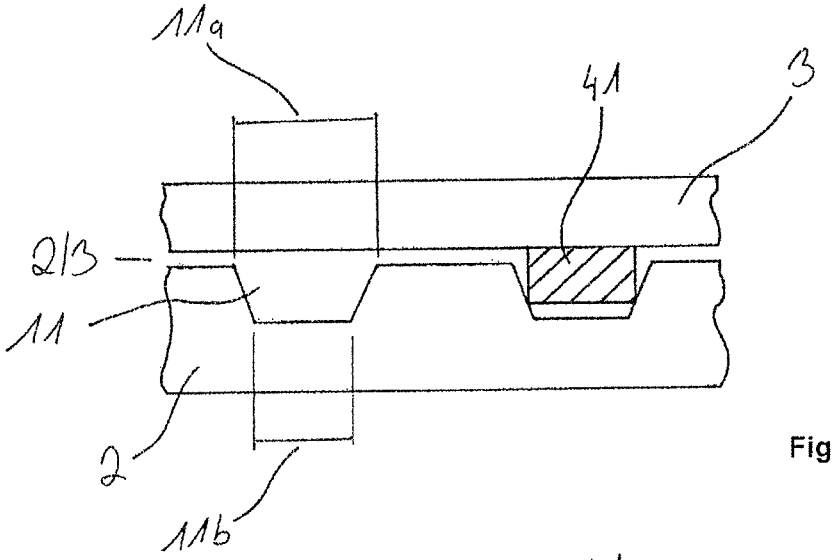
Figure 5B:
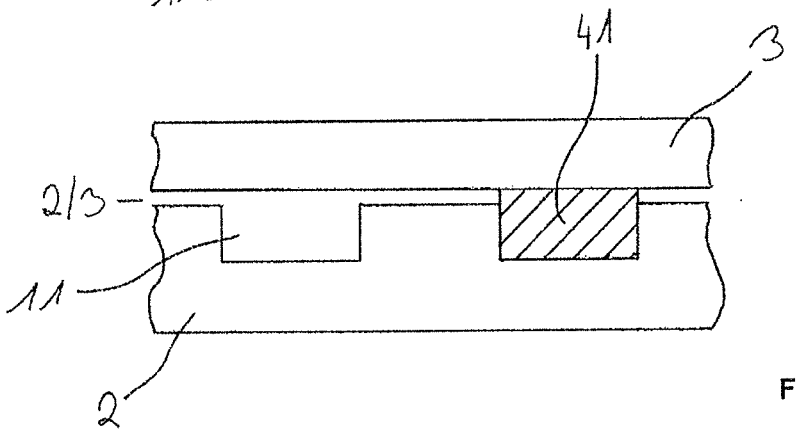
Figure 5C:
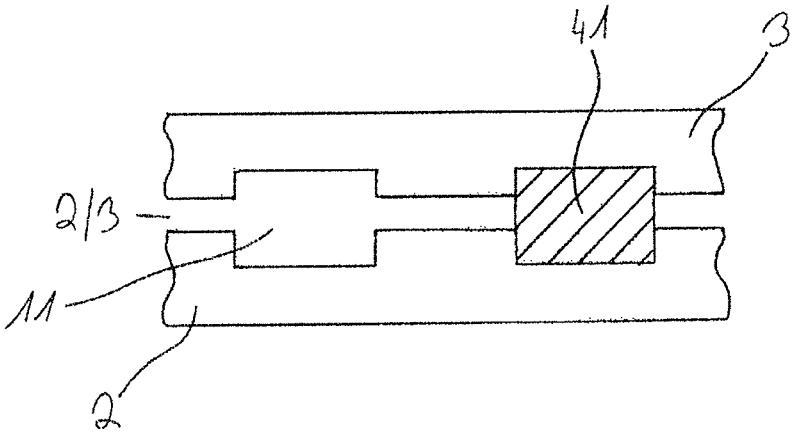
Figure 5D:
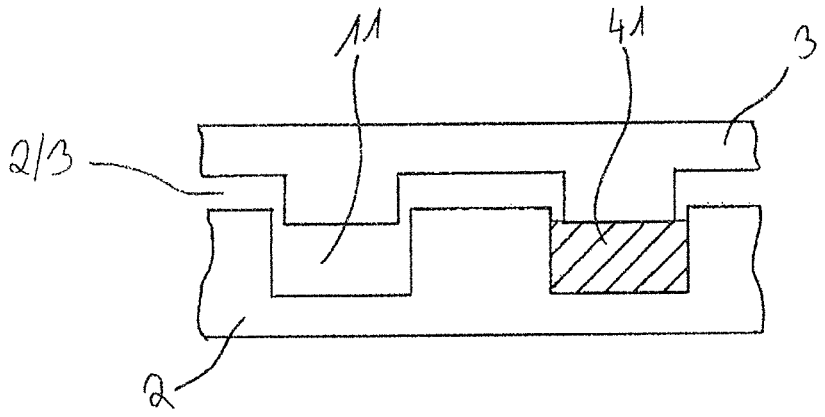
Figure 5E:
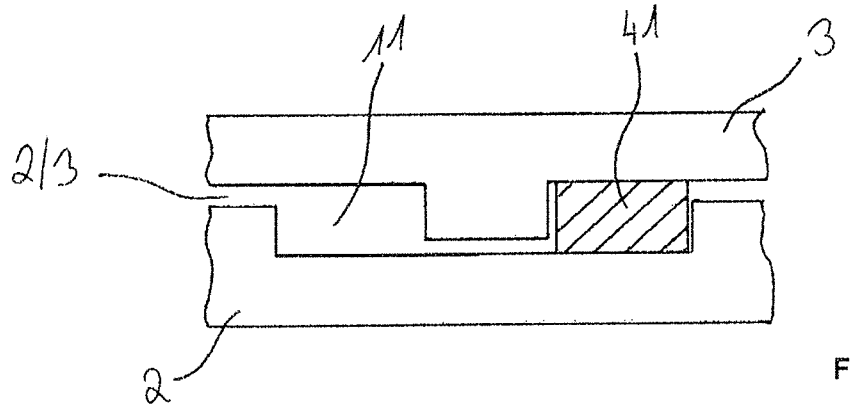
Figure 6A:
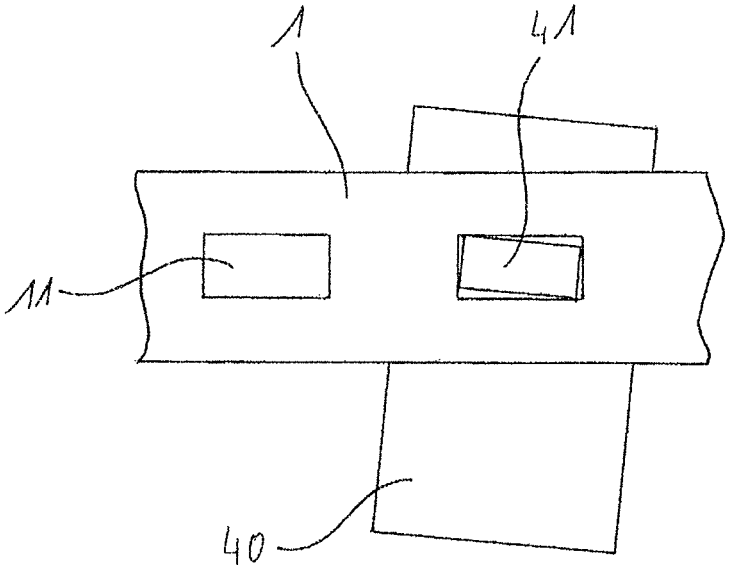

FIG. 5*a* shows a trapezoidal form of recess in the frame base of the retaining frame;

FIG. 5*b* shows a rectangular recess in the frame base of the retaining frame;

FIG. 5*c* shows recesses in the frame base and the securing frame;

FIG. 5*d* shows the recess in the frame base to be greater than the retaining means in the securing frame;

FIG. 5*e* shows a recess in the frame base which can receive two retaining means;

FIG. 6*a* shows a conventional prior art holding frame; and

Figure 6B:
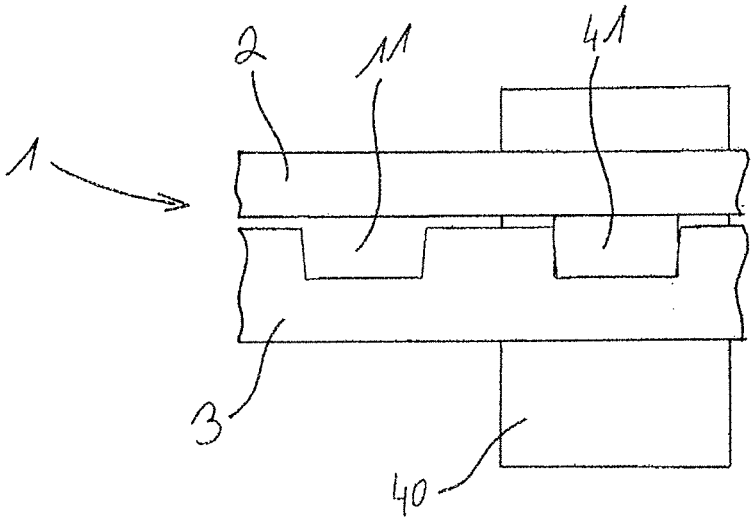

FIG. 6*b* shows the holding frame of the present invention

Figure 1:
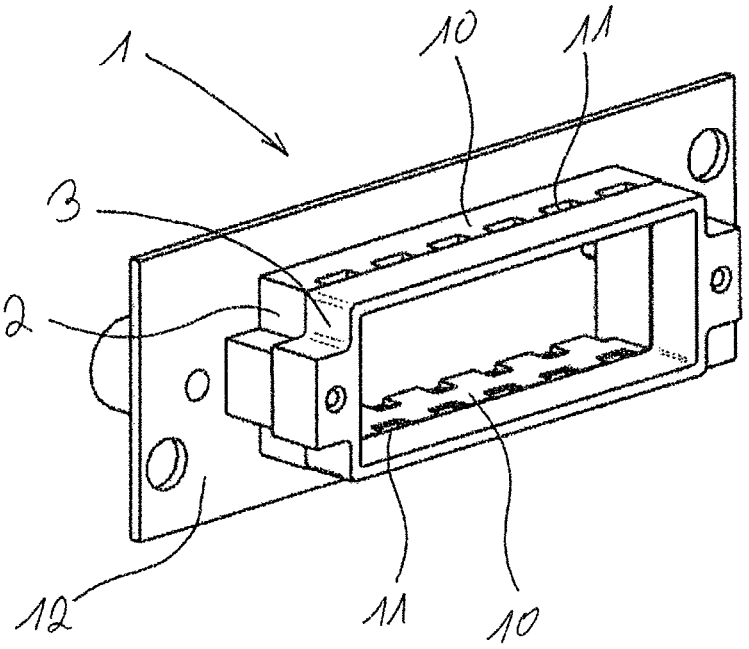
FIG. 1 shows a retaining frame according to the invention.

FIG. 1 shows a retaining frame 1 according to the present invention. It consists of a frame base 2 and a securing frame 3. The retaining frame 1, which is designed to be substantially rectangular, has two opposite wall portions 10. In each of these wall portions 10, six recesses 11 are provided here.

The recesses 11 are used for receiving retaining means, i.e., retaining elements, 41 that are provided on plug-in connector modules. By inserting at least one plug-in connector module 40 into the retaining frame 1, a modular plug-in connector is formed.

Further, the retaining frame 1 has a flange 12, by means of which the retaining frame can be mounted to a housing or device. The detailed design of the flange 12 and the attachment of the holding frame 1 to a housing or device are not addressed in any more detail in the present invention. They are known from the prior art and are not part of the present invention.

Figure 2:
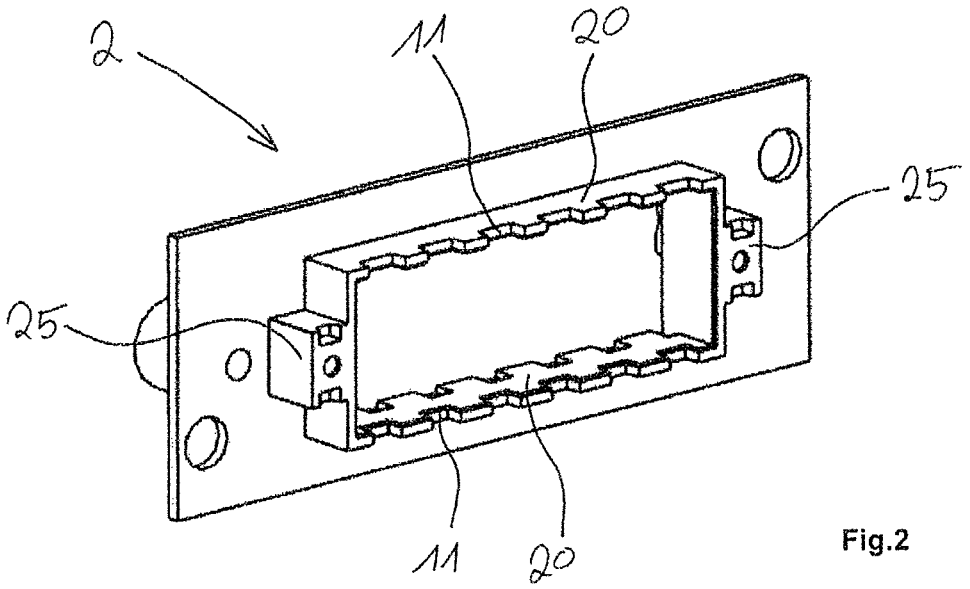
FIG. 2 shows a frame base according to the invention.

FIG. 2 shows a frame base 2 according to the invention, In each of two opposite wall portions 20 of this frame base, two associated recesses 11 are inserted. The recesses 11 are used for receiving the retaining means 41 of plug-in connector an modules.

According to the present invention, the recesses 11 are provided, closed only on three sides, in the area of the wail portions 20, in which the securing frame 3 is fastened. Thus, the recesses 11 are closed on the fourth side thereof by means of the securing frame 3, as can also be seen in FIG. 1

Figure 3:
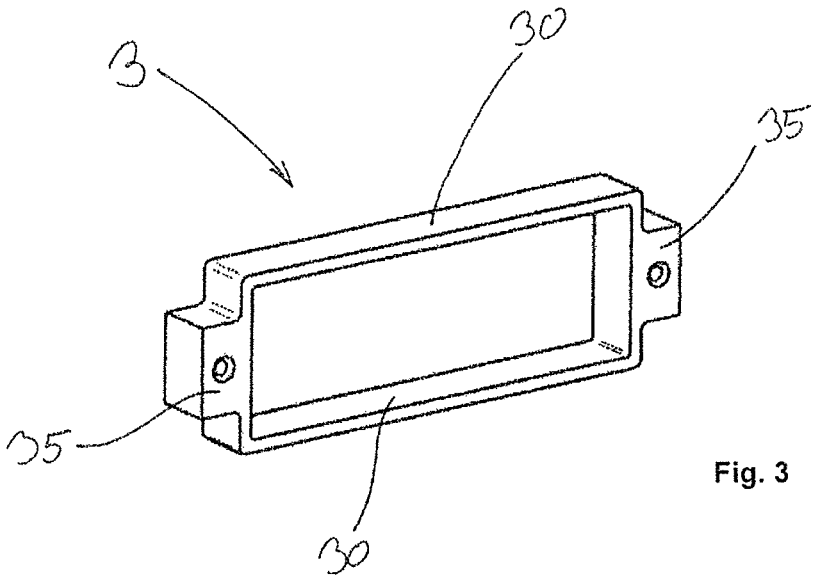
FIG. 3 shows a securing frame according to the invention.

A securing frame 3, which can be assembled with the frame base 2, is shown in FIG. 3. This substantially consists of a base body adapted to the frame base 2, wherein two opposite wall portions 30 close the recesses 11 of the frame base 2.

Fastening means 35 are laterally provided on the securing frame 3. They are used in conjunction with fastening means 25, see FIG. 2, for fastening and fixing the frame base 2 and the securing frame 3 to each other.

Expediently, the fastening is carried out using screws, since in this way, the distance between the frame base 2 and the securing frame 3 relative to each other can be varied. However, also other ways of fastening are conceivable, so that the present invention is not limited to screwing.

Figure 4:
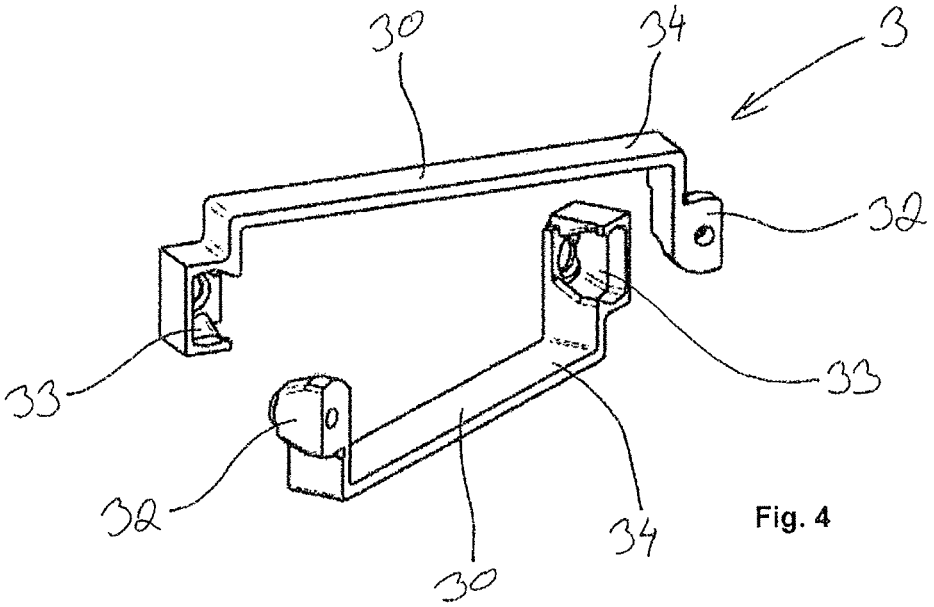
FIG. 4 shows a two-part securing frame according to the invention.

FIG. 4 shows a further expedient embodiment of the securing frame 3, in which the securing frame 3 is designed in two pieces, two half-frames 34.

In this depicted special embodiment, the two half-frames 34 are designed to be identical. This means that a hermaphroditic assembly of two half-frames 34 is possible. As a result, the number of parts to be produced is reduced.

An advantage of a two-piece securing frame 3 is that provision of the securing frame 3 is still possible after the insertion of several plug-in connector modules 40 provided with cables into the frame base 2. In this way, the half-frames 34 can be placed around the wiring harness and can be joined together to form the securing frame 3.

For the assembly, each of the half-frames 34 has a first reception means, i.e., first receptor, for 32 and a second reception means, i.e., second receptor, 33, which may together be placed inside each other in an interlocking manner. Thus, the first reception means 32 is implemented in this embodiment as a truncated cone and can be inserted into the second reception means 33, which is formed as a frustoconical recess. The reception means 32, 33 together form at the same time the fastening means 35 for fastening the securing frame 3 to the frame base 2.

FIGS. 5*a* to 5*e* show different embodiments in respect of how the recesses 11 can be inserted into the retaining frame 1 and can be positioned there.

In FIG. 5*a*, the recess 11 is substantially inserted into the frame base 2. The securing frame 3 terminates the recesses 11 on the side shown here at the top. In doing so, a slot 2/3 is formed between the frame base 2 and the securing frame 3 as a result of the dimension of the received retaining means 41.

In this special embodiment of FIG. 5*a*, the recess 11 is moreover formed to be trapezoidal. This trapezoidal form is used for an improved, play-free seating of retaining means 41 in the recess 11.

In this connection, also other forms of the recess 11 are conceivable. They merely need to have a wider area 11*a* and a narrower area 11*b*. In this respect, the wider area 11*a* has to be located in the vicinity of the slot 2/3 in order to allow the retaining means 41 to be inserted.

In FIG. 5*b*, the recess 11 is present in the frame base 2 as in FIG. 5*a*, and is terminated by the securing frame 3. Contrary to FIG. 5*a*, the recesses 11 are here designed to be rectangular.

In contrast, the recess 11 in FIG. 5*c* is inserted both into the frame base 2 and into the securing frame 3. These part-recesses 21, 31 together form the recess 11 for receiving the retaining means 41.

In FIG. 5*d*, the recess 11 is present in the frame base 2, however, the recess 11 is dimensioned to be greater than the retaining means 41. This is here compensated by a moulding on the securing frame 3 in the area of the recess 11, in order to ensure a play-free seating of the retaining means 41.

In a final depicted embodiment, FIG. 5*e* shows a recess 11 in the frame base 2, which can receive two retaining means 41, wherein the retaining means 41 are separated by a moulding on the securing frame 3, which is provided there between.

All of the embodiments shown in FIGS. 5*a* to 5*e* are also conceivable and useable respectively with interchanged reference numerals 2 and 3.

Finally, FIGS. 6*a* and 6*b* still show a comparison of the holding frame 1 (FIG. 6*b*) according to the invention with a conventional holding frame 1 as known from the prior art (FIG. 6*a*).

In FIG. 6*a* it can easily be seen that play is created in the recess 1 as a result of the required tolerances of the retaining means 41. As a result, the plug-in connector module 40 may tilt in the retaining frame.

By contrast, in FIG. 6*b* a clamping of the retaining means 41 by the two-piece retaining frame 1 is possible. As a result, any tipping of the plug-in connector module 40 in the retaining frame 1 is prevented.

LIST OF REFERENCE NUMERALS

1. Retaining frame
10. Wall portion
11. Recess
11*a*. Wide area of 11
11*b*. Narrow area of 11
12. Flange
2/3 Slot
2. Frame base
20. Wall portion of 2
21. Part-recess in 2
25. Fastening means or element of 2
3. Securing frame
30. Wall portion of 3
31. Part-recess in 3
32. First reception means or first receptors
33. Second reception means or second receptors
34. Half-frame
35. Fastening means or elements of 3
40. Plug-in connector module
41. Retaining means or retaining elements

The invention claimed is:

1. A retaining frame mountable around an opening of a panel for retaining a retaining element of a plug-in connector module, the retaining frame comprising:

a frame base having a base wall and a flange extending from the base wall for mounting on the panel, the frame base having a plurality of recesses formed on the base wall opposite from the flange; and a securing frame having a frame wall and a plurality of protrusions formed on the frame wall for engaging the recesses respectively;

wherein the retaining elements are sandwiched between the protrusions and the recesses when the frame base and the securing frame are fastened to each other.

2. The retaining frame according to claim 1, wherein the frame base and the securing frame are attached to each other and have a spacing therebetween, wherein said recesses are formed by said frame base and securing frame, wherein each of said recesses have a wider area and a narrower area, wherein the wider area is located closer to said spacing between said frame base and securing frame, and wherein the securing frame is made up of two half-frames.

3. The retaining frame according to claim 2, characterized in that the half-frames are identical.

4. The retaining frame according to claim 3, characterized in that the half-frames each have two receptors, wherein the first receptor can be connected to the second receptor in an interlocking manner.

5. The retaining frame according to claim 4, characterized in that the first receptor is formed to be frustoconical and the second receptor has a corresponding frustoconical recess, into which the first receptor can be inserted.

6. The retaining frame according to claim 4, characterized in that the first receptor is formed to have the shape of a truncated pyramid and the second receptor has a corresponding recess in the shape of a truncated pyramid, into which the first receptor can be inserted.

7. The retaining frame according to claim 1, characterized in that the securing frame is attached to the frame base by fastening elements suitable for compensating the spacing between the securing frame and the frame base in a variable manner.

* * * * *